United States Patent [19]

Suto

[11] Patent Number: 4,816,795

[45] Date of Patent: Mar. 28, 1989

[54] DIRECTIONAL CONTROL DEVICE FOR A MOVABLE TOY

[75] Inventor: Shohei Suto, Tokyo, Japan

[73] Assignee: Taiyo Kogyo Co., Ltd., Tokyo, Japan

[21] Appl. No.: 83,975

[22] Filed: Aug. 11, 1987

[30] Foreign Application Priority Data

Dec. 29, 1986 [JP] Japan ..... 61-200166[U]

[51] Int. Cl.[4] ..... H01F 7/08; A63H 29/22

[52] U.S. Cl. ..... 335/272; 446/460

[58] Field of Search ..... 46/129, 437, 443, 456, 46/460, 468, 484, 455; 180/79.1; 335/272, 279; 273/86 B; 310/154; 324/146, 141, 144, 134, 133, 154 R, 151; 340/815.26

[56] References Cited

U.S. PATENT DOCUMENTS

| | | | |
|---|---|---|---|
| 1,881,457 | 10/1983 | Froeckman | 324/133 |
| 3,286,397 | 11/1966 | Lohr | 446/460 |
| 4,453,712 | 6/1984 | Lee | 446/460 X |
| 4,571,213 | 2/1986 | Ishimoto | 446/129 X |

FOREIGN PATENT DOCUMENTS

| | | | |
|---|---|---|---|
| 3003707 | 8/1981 | Fed. Rep. of Germany | 446/460 |
| 53-51270 | 12/1978 | Japan . | |
| 56-29037 | 7/1981 | Japan . | |
| 60-1759 | 1/1985 | Japan . | |

*Primary Examiner*—Mickey Yu

*Attorney, Agent, or Firm*—Oblon, Fisher, Spivak, McClelland & Maier

[57] ABSTRACT

A directional control device for use in a movable toy such as a radio control car, which has a cylindrical magnet, a magnetic yoke disposed rotatably within the magnet and having an electromagnetic coil, and steering arms attached to driven wheels of the toy. The direction of the movable toy in motion can readily be changed selectively by applying a DC current of one polarity to the coil so as to electromagnetically rotate the yoke, thereby to turn the steering arms in conjuction with the rotating yoke.

1 Claim, 4 Drawing Sheets

DIRECTIONAL CONTROL DEVICE FOR A MOVABLE TOY

BACKGROUND OF THE INVENTION

1. Field of the Invention

This invention relates to a directional control device for use in movable toys which are driven by radio control.

2. Description of the Prior Art

A prior art directional control device incorporated in, for example, a radio control toy car is disclosed in Japanese Utility Model Publication SHO No. 56-29037. This known directional control device is composed of an exerting disc member which is urged by a spring so as to be engaged with one of front driven wheels under a straight driving condition and an electromagnetic means which is adapted to attract the disc member so as to bring the disc member into frictional contact with magnetic pole pieces of the electromagnetic means. By bringing the disc member into contact with the magnetic pole pieces by the electromagnetic means, one of the front driven wheels, which is provided with the disc member, is controlled to turn the toy car in motion.

Also, reference may be made to Japanese Utility Model Publications SHO No. 53-51270 and SHO No. 60-1759, both of which relate to directional control devices each comprising a reversible motor and a gear mechanism driven by the motor in accordance with instructions issued in terms of radio command signals.

However, the known directional control device using a spring means as typified by Japanese Utility Model Publication Gazette SHO No. 56-29037 entails a problem such as gradual degradation of performance during the course of prolonged use because of elongation of the spring.

On the other hand, the conventional device using the reversible motor and the gear mechanism as typified by Japanese Utility Model Publications SHO No. 53-51270 and SHO No. 60-1759 suffers a disadvantage that it is complicated in structure and the response to the command signal is degraded.

SUMMARY OF THE INVENTION

It is an object of this invention is to provide a directional control device for a movable toy which has a remarkably simple structure without need of any spring or gear mechanism as used in the prior art device and is capable of swiftly controlling the direction of the movable toy with high reliability.

Another object of this invention is to a directional control device which can assure high stability of the turning operation.

In order to achieve the foregoing objects, the present invention provides a directional control device for use in a movable toy which comprises a cylindrical magnet, a yoke of a magnetic material which is disposed within the cylindrical magnet and provided with a electromagnetic coil, a control unit for selectively applying one of two kinds of electric currents opposite in polarity to the coil wound on the yoke, and steering arms attached to wheels of the movable toy, wherein the yoke is rotatably mounted in the cylindrical magnet and connected with the steering arms.

When no electric current is applied to the electromagnetic coil wound on the yoke, the yoke disposed in the cylindrical magnet is held in its steady state, thereby to permit the rectilinear movement of the movable toy.

The application of an electric current of one polarity to the electromagnetic coil causes the yoke to be magnetized to generate magnetic attraction force and repulsion force between the yoke and the cylindrical magnet, thereby to rotate yoke in one direction. Consequently, the rotational motion of the yoke is transmitted to the steering arm, thereby to change the direction of the movable toy in motion. When an electric current of the opposite polarity is applied to the electromagnetic coil, the yoke is electromagnetically rotated in the opposite direction because the magnetic poles of the yoke are reversed, thereby to direct the wheels of the movable toy to the opposite direction.

Thus, according to this invention, the direction of the movable toy in motion can readily be changed by selectively changing in polarity an electric current to be applied to the magnetic coil wound on the yoke.

Further, by providing a notch in the middle of each of the extreme tip portions of the yoke, the yoke can be held stably in its steady position owing to the magnetic flux of the magnet, when no electric current is applied to the electromagnetic coil, consequently to enable stable rectilinear movement of the movable toy.

BRIEF DESCRIPTION OF THE DRAWINGS

Additional and other objects, features and advantages of the invention will become apparent from the description set forth hereinafter when considered in conjunction with the accompanying drawings, in which.

DESCRIPTION OF THE PREFERRED EMBODIMENT

Figure 1:
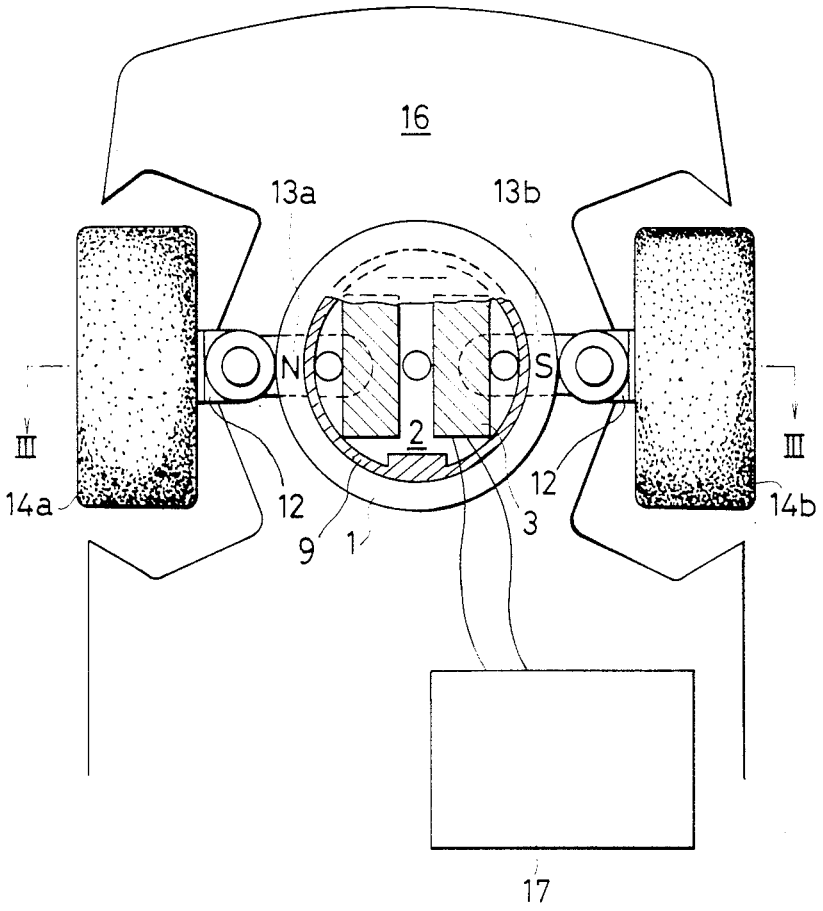
FIG. 1 is a schematic sectional plan view of one embodiment of the directional control device according to this invention.
Figure 2:
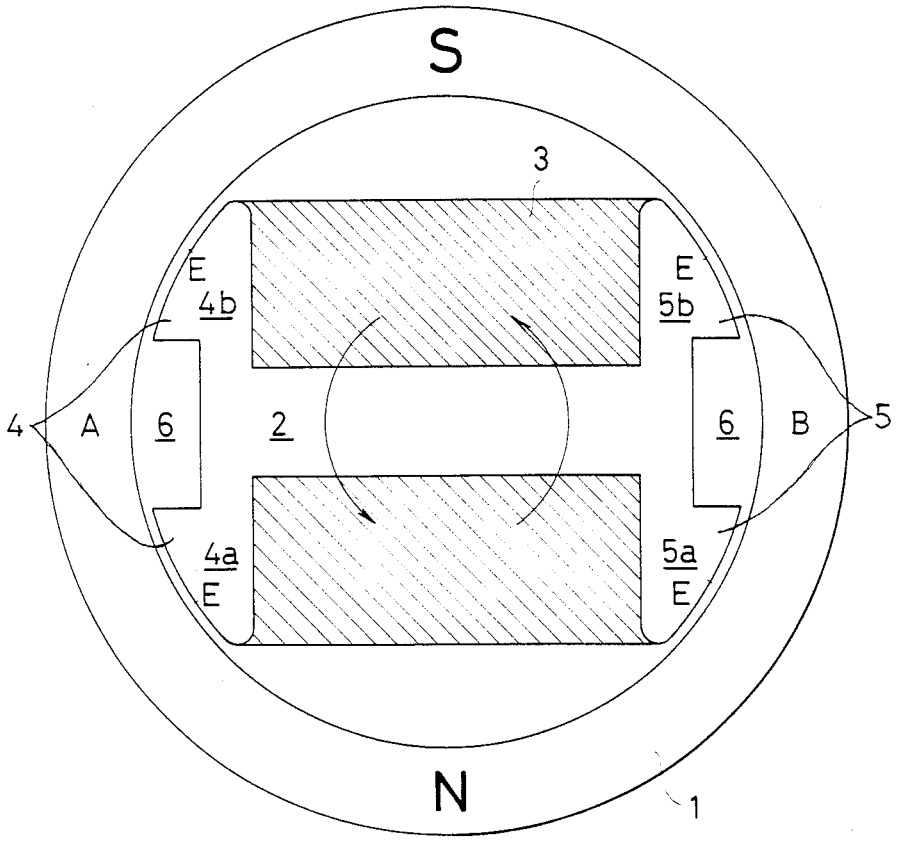
FIG. 2 is a schematic diagram illustrating the principle of operation of this invention.
Figure 3:
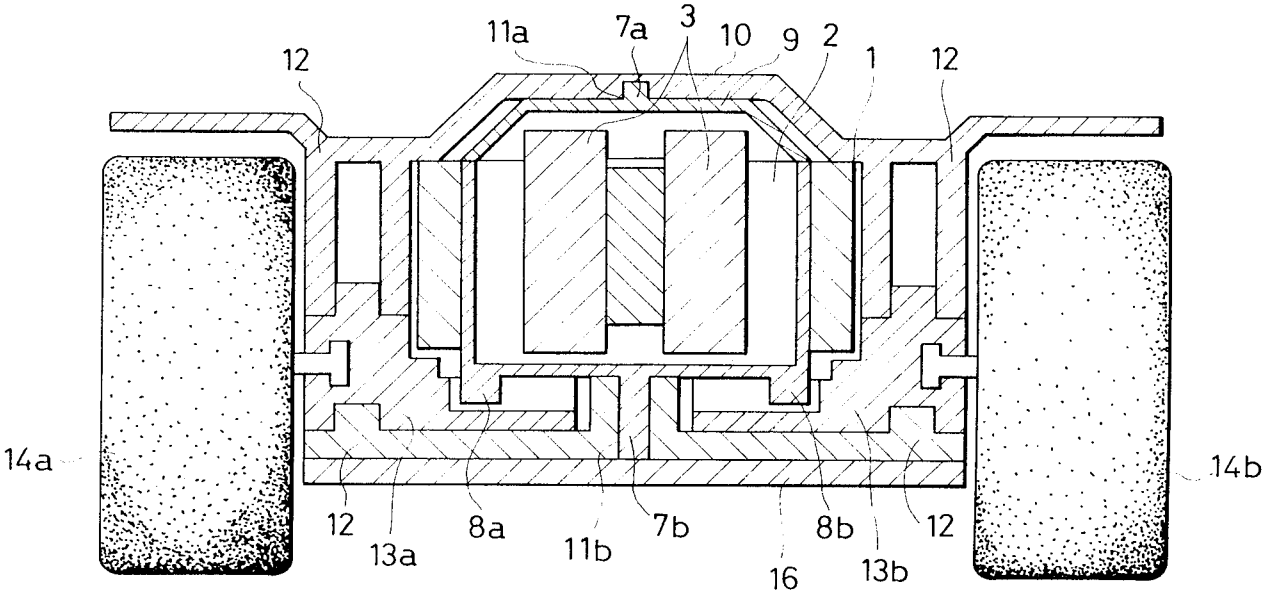
FIG. 3 is a cross-sectional view taken on the lines III—III of FIG. 1.
Figure 4:
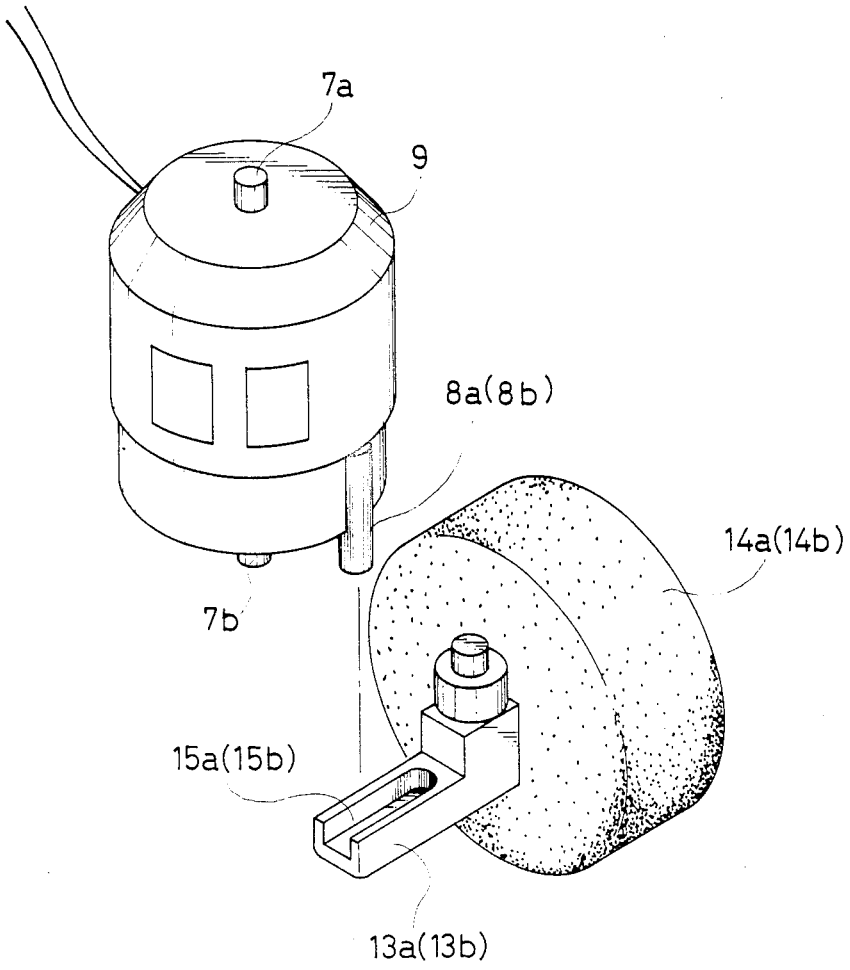
FIG. 4 is an exploded perspective view illustrating the positioning relation between the yoke holder and the steering arm of the same embodiment.

An embodiment of the directional control device according to this invention will now be described with reference to the drawings.

In the drawings, the reference numeral 1 denotes a cylindrical permanent magnet. This magnet 1 has central points A, B and is provided at one of intermediate points between the points A and B with a north magnetic pole N and at the other intermediate point with a south magnetic pole S. Denoted by 2 is a yoke made of a magnetic material. The yoke 2 has an electromagnetic coil 3 wound thereon. In the middles of the opposite extreme tip portions 4, 5, there are formed notches 6 by which half parts 4*a*, 4*b* and 5*a*, 5*b* are separated.

The yoke 2 is incorporated in a yoke holder 9 which is provided at its upper and lower centers with rotating shafts 7*a*, 7*b* and on its lower side portions with protrusions 8*a*, 8*b*. The yoke holder 9 is disposed within the cylindrical magnet 1. The reference numeral 10 denotes a covering case for containing the cylindrical magnet 1. The covering case 10 can be divided into upper and lower parts. That is to say, the covering case 10 includes the cylindrical magnet 1 accommodating the yoke holder 9. The covering case 10 has upper and lower bearing holes 11*a*, 11*b* into which the rotating shafts 7*a*, 7*b* extending from the upper and lower surfaces of the yoke holder 9 are inserted so as to allow the yoke holder 9 to rotate freely within the cylindrical magnet 1.

The covering case 10 is provided on either side portion with a supporting member 12 for supporting steering arms 13*a*, 13*b* so as to allow the steering arms to rotate pivotally in the forward or rearward direction. At the basal ends of the steering arms 13*a*, 13*b*, there are rotatably supported axles mounted on wheels 14*a*, 14*b* of the movable toy. The other ends of the steering arms 13*a*, 13*b* are located in the covering case 10 and provided with slender grooves 15*a*, 15*b* with which the protrusions 8*a*, 8*b* are engaged so as to allow the steering arms 13*a*, 13*b* to be rockingly rotated in conjunction with the yoke 2 which is driven by the application of electric current. The covering case 10 is mounted on a chassis 16.

In the radio control toy having the directional control device as noted above, when an electric current is not applied to the electromagnetic coil 3, the yoke 2 disposed in the cylindrical magnet 1 is directed to the central points A, B of the cylindrical magnet 1 so as to interrupt the magnetic flux formed between the north and south magnetic poles N, S. At this time, the protrusions 8*a*, 8*b* extending downward from the yoke holder 9 are in the lateral positions relative to the chassis 16, and the steering arms 13*a*, 13*b* being in engagement with the protrusions 8*a*, 8*b* assume their rectilinear posture. In this condition, when a driving command signal is issued from a radio remote controller (not shown), the movable toy makes a straight drive.

On the other hand, when a turning command signal is issued from the remote controller, a control unit 17 mounted on the chassis 16 receives the command signal and allows a DC current of one polarity to flow through the electromagnetic coil 3. Accordingly, the yoke 2 generates north and south magnetic poles at the extreme tip portions 4, 5 thereof by applying the DC current to the electromagnetic coil 3, thereby to create attraction force and repulsion force relative to the N- and S-magnetic poles of the magnet 1. Consequently, the yoke 2 rotates within the cylindrical magnet 1, thereby to cause the steering arms 13*a*, 13*b* to be pivotally moved by the protrusions 8*a*, 8*b* of the yoke holder 9. As a result, the movable toy in motion turns in one direction.

When the opposite-directional command signal is issued from the remote controller, the control unit 17 permits a DC current of the opposite polarity to be given to the electromagnetic coil 3, thereby to generate the opposite magnetic poles relative to the covering case noted above on the extreme tip portions of the yoke 2. Accordingly, the yoke 2 rotates reversely in the cylindrical magnet 1, and consequently, the movable toy in motion turns in the opposite direction.

As is mentioned above, the movable toy can freely change its driving direction in accordance with the directional command signal given in terms of the reversible polarity of the DC current to be applied to the electromagnetic coil 3. Besides, the yoke 2 disposed in the cylindrical magnet 1 can smoothly rotate because the magnet 1 is formed in the shape of a ring or cylinder. Therefore, the steering arms 13*a*, 13*b*, can readily be moved in the desired direction.

In this embodiment, since the extreme tip portions 4, 5 of the yoke 2 are respectively separated into the parts 4*a*, 4*b* and 5*a*, 5*b* by the notches 6, the separated parts 4*a*, 4*b* and 5*a*, 5*b* are equally attracted by the magnetic flux of the magnet 1 to keep the yoke in equilibrium. Therefore, if the yoke 2 accidentally rotates to excess so that the centers E of the parts 4*a*, 5*b* or 4*b*, 5*a* pass beyond the centers A, B of the magnet 1 at a state where no electric current is applied to the coil 3, the yoke 2 is forced to promptly return to and is held in its steady position in which the extreme tip portions 4, 5 thereof are opposite to the centers A, B of the magnet 1 because return force is effected by the magnetic flux of the magnet 1.

As can be seen from the foregoing, the present invention provides a directional control device which enables the driving direction of a radio control movable toy to be readily controlled only by changing the polarity of a DC current to be applied to an electromagnetic coil wound on a yoke in a cylindrical magnet, without use of a spring member exerting elastic force or a complicated gear mechanism for turning the movable toy as used in a conventional toy.

While particular embodiment of the invention has been described, it will be apparent to those skilled in the art that various modifications thereof may be made without departing from the true spirit and scope of the invention. Accordingly, it is intended by the appended claims to cover all such modifications which embody the inventive features as defined in the claims.

What is claimed is:

1. A directional control device for use in movable toys comprising:

a fixed cylindrical magnet for producing a magnetic field;

a rotatable yoke having windings thereon located in two recesses in said yoke, and having two notches formed therein defining said yoke in four parts, said yoke being rotatably mounted in said magnet field such that upon energization of said windings said yoke is moved in one direction with current flowing in one direction and in the opposite direction upon energization by an opposing current and further wherein said yoke is held in a fixed neutral position by the magnetic field of said cylindrical magnet operating on said parts of said yoke when said windings are not energized.

* * * * *